US007709061B2

(12) United States Patent
Craamer et al.

(10) Patent No.: US 7,709,061 B2
(45) Date of Patent: May 4, 2010

(54) METHOD OF DEPOSITING MATERIALS ON A TEXTILE SUBSTRATE

(75) Inventors: Johannes Antonius Craamer, Ijlst (NL); James E. Fox, Cambridge (GB); Gerhard H. Bouwhuis, Losser (NL)

(73) Assignee: Ten Cate Advanced Textiles B. V., Nijverdal (NL)

( * ) Notice: Subject to any disclaimer, the term of this patent is extended or adjusted under 35 U.S.C. 154(b) by 312 days.

(21) Appl. No.: 11/886,715

(22) PCT Filed: Mar. 22, 2006

(86) PCT No.: PCT/EP2006/060964

§ 371 (c)(1),
(2), (4) Date: Sep. 20, 2007

(87) PCT Pub. No.: WO2006/100273

PCT Pub. Date: Sep. 28, 2006

(65) Prior Publication Data

US 2009/0142552 A1 Jun. 4, 2009

(30) Foreign Application Priority Data

Mar. 22, 2005 (GB) ..... 0505873.0

(51) Int. Cl.
*B05D 1/04* (2006.01)
*B05D 1/26* (2006.01)

(52) U.S. Cl. ..... 427/466; 427/265; 427/288

(58) Field of Classification Search ..... 427/466, 427/265, 288
See application file for complete search history.

(56) References Cited

U.S. PATENT DOCUMENTS 3,607,340 A * 9/1971 Stroupe ..... 427/8

(Continued)

FOREIGN PATENT DOCUMENTS

DE 10051088 A 4/2002

(Continued)

OTHER PUBLICATIONS

Breteler et al., "Textile Slow Release Systems with Medical Applications", AUTEX Research Journal, vol. 2, No. 4, Dec. 2002.

*Primary Examiner*—Frederick J Parker
(74) *Attorney, Agent, or Firm*—Howrey LLP; David P. Owen; Coraline J. Haitjema

(57) ABSTRACT

A method of providing deposits of a functional composition on a textile substrate (1) is described. The method comprises providing a supply of the textile substrate (1); providing a first digital nozzle; supplying a functional composition to the first nozzle; providing a second digital nozzle; supplying an encapsulating composition to the second nozzle; selectively depositing the functional composition from the first nozzle to form a series of functional droplets (10) on the substrate (1); and selectively depositing the encapsulation composition from the second nozzle to form a series of encapsulation droplets (16) to at least partially cover the functional droplets (10). In this way, quantities of highly specific functional compositions or "agents" may be precisely deposited at those locations where they are required and may subsequently be covered by an encapsulation composition.

15 Claims, 1 Drawing Sheet

U.S. PATENT DOCUMENTS

| | | | | | |
|---|---|---|---|---|---|
| 5,196,236 | A | * | 3/1993 | Howard et al. | 427/265 |
| 5,683,752 | A | * | 11/1997 | Popp et al. | 427/8 |
| 2001/0046826 | A1 | | 11/2001 | Tebbe | |
| 2004/0241323 | A1 | * | 12/2004 | Ylitalo et al. | 427/258 |

FOREIGN PATENT DOCUMENTS

| | | | | |
|---|---|---|---|---|
| JP | 61152874 | A | | 7/1986 |
| WO | 2005/028731 | | * | 3/2005 |
| WO | 2005028730 | A1 | | 3/2005 |
| WO | 2005028731 | A1 | | 3/2005 |
| WO | 2005287729 | A2 | | 3/2005 |

* cited by examiner

METHOD OF DEPOSITING MATERIALS ON A TEXTILE SUBSTRATE

BACKGROUND OF THE INVENTION

1. Field of the Invention

The present invention relates to methods of finishing a textile substrate. In particular, the invention relates to a digital procedure for producing a textile having encapsulated materials deposited thereon.

2. Description of the Related Art

The production of textiles traditionally takes place in a number of distinct processes. Roughly five stages can be distinguished in such production; the fibre production; spinning of the fibres; the manufacture of cloth (for instance woven or knitted fabrics, tufted material or felt and non-woven materials); the upgrading of the cloth; and the production or manufacture of end products. Textile upgrading covers a number of operations such as preparing, bleaching, optically whitening, colouring (dying and/or printing) and finishing. These operations generally have the purpose of giving the textile the appearance and physical and functional characteristics that are desired by the user.

During dying, the textile substrate is usually provided with a single full plane colour. Dying presently takes place by immersing the textile article in a dye bath, whereby the textile is saturated with an appropriate coloured chemical substance.

Coating of the textile is one of the more important techniques of finishing and may be used to impart various specific characteristics to the resulting product. It may be used for making the substrate fireproof or flameproof, water-repellent, oil repellent, non-creasing, shrink-proof, rot-proof, non-sliding, fold-retaining, antistatic etc. Coating of textile involves the application of e.g. a thin layer of an appropriate chemical substance to the surface of the textile substrate. The coating may serve to protect the textile substrate or other underlying layers. It may also be used as a basis or "primer" for subsequent layers or may be used to achieve desired special effects.

The usual techniques for applying a coating on solvent or water basis are the so-called "knife-over-roller", the "dip" and the "reverse roller" screen coaters. A solution, suspension or dispersion of a polymer substance in water is usually applied to the cloth and excess coating is then scraped off with a doctor knife.

A further procedure sometimes employed for finishing of the textile is the use of immersion or bath techniques such as foularding. The textile is fully immersed in an aqueous solution containing the functional composition that is to be applied. Subsequent repeated cycles of drying, fixation and condensation are required to complete the operation. This leads to considerable use of resources, in particular water and energy. In general, the solutions, suspensions or dispersions used for such techniques have low concentrations of the desired functional composition The conventional upgrading procedures require the performance of a number of sequential operations selected from impregnation (i.e. application or introduction of chemicals), reaction/fixing (i.e. binding chemicals to the substrate), washing (i.e. removing excess chemicals and auxiliary chemicals) and drying. Each of these sequential operations may need to be repeated a number of times e.g. repeated washing and rinsing cycles, which may entail a relatively high environmental impact, a long throughput time and relatively high production costs.

A significant characteristic of conventional upgrading techniques such as dying and coating is that they are performed over the complete surface of the article. This is often referred to as full font treatment. For certain treatments, there may be a desire to finish or coat only certain areas of the textile in order to provide particular characteristics to these areas. It is also often the case that treatments and chemicals used for finishing are particularly expensive and a limited but balanced distribution of the chemical may be sufficient. In such cases, the performance of the treatment over the full textile area may be inefficient and/or wasteful, especially if certain areas of the textile are to be discarded or have no need of the treatment.

Certain products that it would be desirable to include in a textile article are also sensitive to the environment. For this reason, their use has been limited in the past by difficulties in applying the product to the textile such that degradation does not occur. Other functional products have been suggested that it would be desirable to include on textile substrates. Nevertheless, adequate methods for depositing such products have hitherto been unavailable.

It has been suggested to incorporate drugs or medicaments within textile articles by attaching the drug to a carrier. A review of such carriers is to be found in an article by Breteler et al. in Autex Research Journal, Vol. 2 No 4 entitled Textile Slow Release Systems with Medical Applications, the contents of which are hereby incorporated by reference in their entirety. Carriers discussed include cyclodextrines, fullerenes, aza-crown ethers and also polylactic acid (PLA). No indication is given as to the precise manner in which these carriers could be applied.

The use of digital techniques for finishing textiles has been suggested in unpublished PCT application Nos. PCT/EP2004/010732 and PCT/EP2004/010731 both filed on 22 Sep. 2004 the contents of which are hereby incorporated by reference in their entirety.

It has been suggested in unexamined patent application No. JP61-152874 to Toray Industries, to impregnate a textile sheet with a functional composition in the form of dots. Various functional compositions are suggested including antibiotics, moisture absorbents, water repellents, antistatic agents, ultraviolet rays absorbents, infrared rays absorbents, optical whitening agents, swelling agents, solvents, saponifier, embrittlement agent, inorganic granules, metal granules, magnetic material, flame retardants, resistance, oxidants, reducing agents, perfumes, etc. The document indicates that traditional photogravure roll and screen print methods produce patterns of dots that may be too large, while in spraying techniques, the dot size and quantity of product deposited is difficult to control. The document proposes impregnating a textile with a functional composition in the form of dots, wherein a mean dot diameter is 30 to 500 microns and the occupied area ratio thereof is 3 to 95%. Although the document suggests the use of inkjet printing techniques, it identifies conventional inkjet devices as being unsuitable, in particular due to the high viscosity of traditional coating compositions. The document is concerned primarily with maintaining an identifiable droplet structure and preventing the droplets from running together. Furthermore, the document provides examples regarding the use of solutions but fails to address the problems of inkjet deposition of dispersions or suspensions.

Inkjet printers of various types are generally known for providing graphic images. Such printers may be desktop inkjet printers such as used in the office or home and are generally used for printing onto a particular type of paper substrate (printer paper), using small droplets (<20 pL) of water based inks containing colorants. Larger, industrial inkjet printers also exist for printing graphic images or date/batch codes onto products; these printers are typically printing onto non-porous substrates using solvent based inks containing colorants pigments. Such formulations are not however suitable for application to most textiles in particular due to lack of colour fastness. In order to print onto textiles using inkjet techniques, textile articles have in the past been pretreated with a coating onto which ink droplets may be applied. For upgrading purposes, most currently used coatings and finishing compositions are unsuitable for deposition using inkjet techniques. Industrial inkjet printers and nozzles that produce large droplets are generally designed for use with solvent based, coloured inks. Furthermore, the droplet volumes that can be jetted are extremely low, in the order of 50 pL and mostly insufficient for textile finishing, where a significant penetration into the fabric is necessary. Typical finishing formulations are mostly water based and generally have particle sizes that can cause clogging of the nozzles. Additional problems with foaming, spattering and encrustation have been encountered. When working with large numbers of nozzles operating continuously at up to 100 KHz, reliability and fault free operation are of prime importance. While indicating that conventional inkjet devices are unsuitable for applying finishing compositions, JP61-152874 fails to provide teaching regarding how this could be improved.

BRIEF SUMMARY OF THE INVENTION

According to the present invention there is provided a method of providing deposits of a functional composition on a textile substrate comprising: providing a supply of the textile substrate; providing a first digital nozzle; supplying a functional composition to the first nozzle; providing a second digital nozzle; supplying an encapsulating composition to the second nozzle; selectively depositing the functional composition from the first nozzle to form a series of functional droplets on the substrate; and selectively depositing the encapsulation composition from the second nozzle to form a series of encapsulation droplets to at least partially cover the functional droplets. In this way, quantities of highly specific functional compositions or "agents" may be precisely deposited at those locations where they are required and may subsequently be covered by an encapsulation composition.

In the present context, the term "functional composition" is understood to mean a composition or agent that imparts a functionality to the textile substrate rather than merely providing it with a coloured design or changing its visual appearance as is the case with conventional inkjet printing using inks and dyes. According to an important advantage of the invention, the composition may be non-reactive with the substrate. In this manner, the formulation may be applied to a greater diversity of substrates than would otherwise be the case.

The term "digital nozzle" is intended to refer to a device for emitting a defined droplet from a supply of agent in response to a digital signal and depositing the droplet at a defined and controllable position. The term includes inkjet-printing heads working on both the continuous flow and drop-on-demand principles. It also includes both piezoelectric and thermal inkjet heads and encompasses other equivalent devices such as valve jets, capable of digital droplet deposition. Digital nozzles are generally well known to the skilled person in the field of graphic printing. It is considered that the nozzles of this invention can have an outlet diameter between 10 and 150 microns, preferably around 70 to 90 microns.

The term "textile" is intended to encompass all forms of textile article, including woven textiles, knitted textiles and non-woven textiles. The term is intended to exclude fibrous articles having two-dimensional rigidity such as carpets, paper and cardboard. These fibrous articles, although sometimes referred to as textiles, are internally linked in such a way that they maintain a substantially fixed two-dimensional form. Even though they may be flexible in a third dimension they are not generally free to stretch or distort as is inherent in a true textile. Preferably the textile substrate is more than 100 meters in length and may be provided on a roll having a width of greater than 1 meter. Preferred textiles comprise cotton and/or other treated cellulosic fibres and also polyesters, polyamides, polyacrylnitril and acetates and triacetates or blends thereof.

The method is preferably carried out in a continuous process. Accordingly, the textile substrate may be supplied in a continuous manner such as from a roll or directly from a previous process.

According to an important aspect of the present invention, a transport surface may be provided for moving the textile substrate past the first and second nozzles, the substrate being retained by the transport surface for movement therewith. Because of the ability of textiles to stretch or distort, the use of such a transport surface may ensure that the substrate remains flat and that no relevant movement takes place during the process. If the position of the substrate were to move between the deposition of the functional droplet and the deposition of the encapsulation droplet, then accurate encapsulation would not be possible. The transport surface may be in the form of a conveyor belt, to which the substrate is temporarily affixed e.g. by a release adhesive or by vacuum. Alternatively, the transport surface may be a shape-retaining carrier layer to which the textile is affixed, e.g. a backing film. Suitable control of the transport surface may be provided, interacting with control of the droplet deposition.

The encapsulation may take place of individual functional droplets or of a number of functional droplets collectively. Thus functional droplets may be applied in a first functional arrangement and subsequently covered collectively by one or more encapsulation droplets. According to a particular embodiment of the invention, the encapsulation droplets may be larger than the functional droplets and each encapsulation droplet substantially covers a corresponding functional droplet. This one-on-one relationship may be desirable for producing minute deposits of encapsulated functional material.

In an alternative embodiment, a plurality of encapsulation droplets can together cover a single functional droplet. In this way, more complete encapsulation of the functional droplet may be achieved. The encapsulation droplets may all be deposited by the same nozzle or may be deposited from different nozzles. Furthermore, they may be deposited adjacent to each other to each cover a portion of the functional droplet. By careful positioning of the droplets, a pore or opening may be formed through the layer. Alternatively the encapsulation droplets may be deposited over one another to build up an encapsulation layer. If the encapsulation droplets are deposited from different nozzles, they may each comprise a different composition whereby e.g. a multi layer encapsulation may be formed.

The underside of the functional droplet may be in direct contact with the substrate. In this case, the textile substrate itself may form part of the encapsulation and may be active in determining the activity of the functional droplet. The textile may thus serve as e.g. a barrier layer, a rate determining layer or a wicking layer. The textile substrate may be pretreated or otherwise coated to enhance this function. According to an important feature of the present application, the method may further comprise: providing a third digital nozzle; supplying a foundation composition to the third nozzle; selectively depositing the foundation composition from the third nozzle, prior to depositing the functional composition, to form a series of foundation droplets on the substrate, the functional droplets being subsequently deposited on the foundation droplets. The foundation droplets may be deposited on the same side of the substrate as the functional droplets. Alternatively, they may be deposited on the opposing face of the substrate. In this case, the foundation droplet may clearly be deposited subsequent to deposition of the functional droplet.

By first providing a foundation droplet, the functional droplet may be "sandwiched" between a foundation layer and an encapsulation layer. Both or either of the foundation and encapsulation droplets may form a protective layer to prevent degradation of the functional droplets. Alternatively or additionally both or either may form a rate-determining layer to control a rate of activity of the functional droplets. Although reference is made to the encapsulation layer "covering" the functional droplet, it may also be located beneath the functional droplet i.e. in place of the foundation droplet or the droplets of the two layers may intimately mix or even react together. Of importance to the present invention is the ability to carefully place the droplets with respect to one another.

The precise composition and function of the foundation and encapsulation droplets will depend to a large extent on the nature of the functional droplet.

The functional droplet may comprise a medicinal or pharmacological agent, a biological agent or a bio-chemical functional agent. Such compositions may have anti-biological activity e.g. anti-allergic, anti-fungal, anti-bacterial or anti-viral. Such agents may include cyclodextrines, peptides, proteins and enzymes. For these agents low temperature deposition at below 40° C. is desirable. In these cases good retention on the substrate is important. This may be combined with a foundation layer that controls the rate of release e.g. towards the body and an encapsulation layer that prevents release towards the outside. Such textiles may be integrated into wound dressings and bandages as well as into conventional garments.

In a particularly useful form of functional droplet, the drug or medicinal or biologically active agent is deposited on the substrate within a carrier. Appropriate carriers include cyclodextrines, fullerenes, aza-crown ethers and also polylactic acid (PLA). These carriers are ideally suited for attachment both to the textile fibres and to the agent. A review of these carriers is to be found in an article by Breteler et al. in Autex Research Journal, Vol. 2 No 4 entitled Textile Slow Release Systems with Medical Applications. According to an alternative embodiment of the invention, the functional composition may be based on a UV curable organic diluent, preferably present at between 75 and 95 wt % in the jetted composition. Such UV curing compositions are quick to cure, extremely durable and are ideal as carriers for certain functional agents. Particular to UV curing compositions is that substantially the total of the deposited material remains on the substrate. A solvent may however sometimes be added to reduce viscosity although generally this is not preferred. Alternate carriers may be sol gel systems. In all such cases, the carrier may at least partly perform the function of encapsulation layer and no separate deposition of the encapsulation droplet is required. It is also possible to co-deposit the carrier and drug such that integration of drug and carrier takes place on the substrate.

The functional droplet may also comprise an indicator. The indicator may be in the form of a bio-chemical sensor e.g. for signaling the presence or absence of chemical and biological agents or for otherwise indicating the degree of protection offered by the textile against certain environments. The indicators may be chromic, whereby the functional agent undergoes a colour change in response to a given substance. In this case, the encapsulation droplet may control the entry of certain substances and exclude others. Other forms of indicator may be used to achieve self-monitoring textiles: by depositing tracers (e.g. phosphor based) that react to (UV) light, wear of the cloth may be monitored. The encapsulation layer over the indicator droplet may be responsive to wear. Once the encapsulation layer has worn away, the indicator is exposed to light (or other effects) and indicates such exposure by e.g. changing colour.

The functional droplet may also comprise an electronic component. Such an electronic component may form part of an electronic circuit e.g. by depositing semi-conducting polymers, liquid crystals etc. and may operate as part of a sensor, actuator, energy converter, memory component or the like. In such a case, the encapsulation layer and or the foundation layer may also form parts of the electronic circuit. The electronic component may be a part of a circuit or may itself comprise a complete micro or nano-circuit deposited within a single droplet.

For the above-mentioned functional compositions, wherein the functional composition is temperature sensitive the deposition of the functional droplets should take place at a suitable temperature. For biologically active compositions deposition should preferably take place at a temperature below 40° C.

Where the functional composition is sensitive to other environmental conditions the deposition of the functional droplets and the encapsulation droplets may takes place in a controlled environment. As an example, if the functional droplet is sensitive to oxidation, it may be deposited and then encapsulated in an oxygen free atmosphere.

Although different forms of digital nozzle may be used, preferably, the digital nozzles are of the continuous inkjet (CIJ) type and the functional composition is deposited by continuous jet deposition. In the continuous flow method, pumps or other pressure sources carry a constant flow of agent to one or more very small outlets of the nozzles. One or more jets of agent are ejected through these outlets. Under the influence of an excitation mechanism such a jet breaks up into a constant flow of droplets of the same size. The most used excitator is a piezo-crystal although other forms of excitation or cavitation may be used. From the constant flow of droplets generated only certain droplets are selected for application to the substrate of the textile. For this purpose the droplets are electrically charged or discharged. In CIJ, there are two variations for arranging droplets on the textile; binary CIJ and multi-deflection CIJ. According to the binary deflection method, drops are either charged or uncharged. The charged drops are deflected as they pass through an electric field in the print head. Depending on the configuration of the specific binary CIJ printer, the charged drops may be directed to the substrate whilst the uncharged drops are collect in the print head gutter and re-circulated, or vice versa. According to a more preferred method known as the multi-deflection method, the droplets are applied to the substrate by applying a variable level of charge to them before they pass through a fixed electric field, or conversely by applying a fixed level of charge to the drops before they pass through a variable electric field. The ability to vary the degree of the charge/field interaction on the drops means that the level of deflection they experience (and thus their position on the substrate) can be varied, hence 'multi-deflection'. Uncharged drops are collected by the print head gutter and re-circulated. More specifically this method comprises:

feeding the formulation to the nozzles in almost continuous flows;

breaking up the continuous flows in the nozzles to form respective droplets, whilst simultaneously applying an electric field, as required, to charge the droplets;

applying a second electric field so as to deflect the drops such that they are deposited at suitable positions on the textile article.

In the past for the purpose of graphic printing, nozzles having an outlet diameter of up to 50 microns have been used and the general trend is to increasingly smaller nozzle sizes for improved printing resolution and image quality. For the purpose of deposition of a functional or encapsulation composition, nozzle outlets with diameters of greater than 70 microns may be used. In this manner, functional compositions having larger particle sizes and greater percentages of solids can be deposited. The use of larger nozzles is also preferred as the larger droplets produced from these nozzles lead to greater productivity i.e. a higher flow rate (volume of fluid per second) from each nozzle Furthermore, in the case of CIJ the size of the droplet formed can be varied by varying the pump pressure or the excitation frequency for a given nozzle size. By suitable electronic control of these parameters, the droplet size may be controlled. Such control may be varied intermittently e.g. during set-up or calibration but may also be varied on a drop-by-drop basis allowing still further control of the size of the encapsulation.

Use of the continuous inkjet method makes it possible to generate between 64,000 and 125,000 droplets per second per jet. This large number of droplets and a number of mutually adjacent heads over the whole width of the cloth results in a relatively high productivity: in view of the high spraying speed, a production speed can moreover be realized in principle of about 20 meters per minute using this technology, and in view of the small volume of the reservoirs associated with the nozzles, a finishing regime may be realized within a very short time. However, it is a requirement of continuous inkjet that the finishing composition used has a conductivity to allow the droplets to be charged so that they can be deflected by the electric field. Accordingly for CIJ, it is preferable that the finishing composition has a conductivity greater than 500 μS/cm The first, second and/or third digital nozzles are preferably provided in static arrays of multiple nozzles, spanning the width of the textile substrate. In this way substantially higher speeds can be achieved for the transport of the textile compared to systems where the nozzles are required to traverse the moving substrate. In particular, each nozzle may be oriented to provide multi level drop deflection generally perpendicular to the direction of textile supply. In this way, a single nozzle can provide finish over a substrate width of around 5 mm.

In accordance with a preferred embodiment the individual nozzles may be directed with a central control, formed for instance by a computer. The computer may preferably employ a drop and position visualization system that can be used to establish the optimum printhead operating conditions and verify the quality of the droplet formation and the correct positioning thereof.

The present invention also relates to an upgraded textile, manufactured according to the method described above, comprising a textile substrate having a plurality of selectively deposited functional droplets, each functional droplet being at least partially encapsulated by an encapsulation droplet.

Preferably the textile substrate is more than 100 meters in length and may be provided on a roll to have a width of greater than 1 meter. Although individual encapsulated drops may have been previously produced experimentally, it is believed that droplets according to the present invention have not been produced on substrates of such format in a finishing or upgrading procedure.

The functional droplets preferably have a diameter of less than 1 mm. More preferably, they have a diameter of around 200 microns. They may be distributed over the complete surface of the textile e.g. with a distribution density according to the required function.

Furthermore, the invention relates to devices for producing such an upgraded textile according to the above-mentioned methods. In particular, it relates to devices comprising a conveyor for transporting a continuous supply of a textile substrate; a first array of digital nozzles supplied with a functional composition for selectively depositing the functional composition from the nozzles in a series of functional droplets in a predetermined pattern on a selected area of the substrate; a second array of digital nozzles supplied with an encapsulation composition; and a controller for controlling the second array of nozzles to deposit droplets of the encapsulation composition to at least partially cover the functional droplets.

BRIEF DESCRIPTION OF THE DRAWINGS

The features and advantages of the invention will be appreciated upon reference to the following drawings, in which.

DESCRIPTION OF ILLUSTRATIVE EMBODIMENTS

Figure 1:
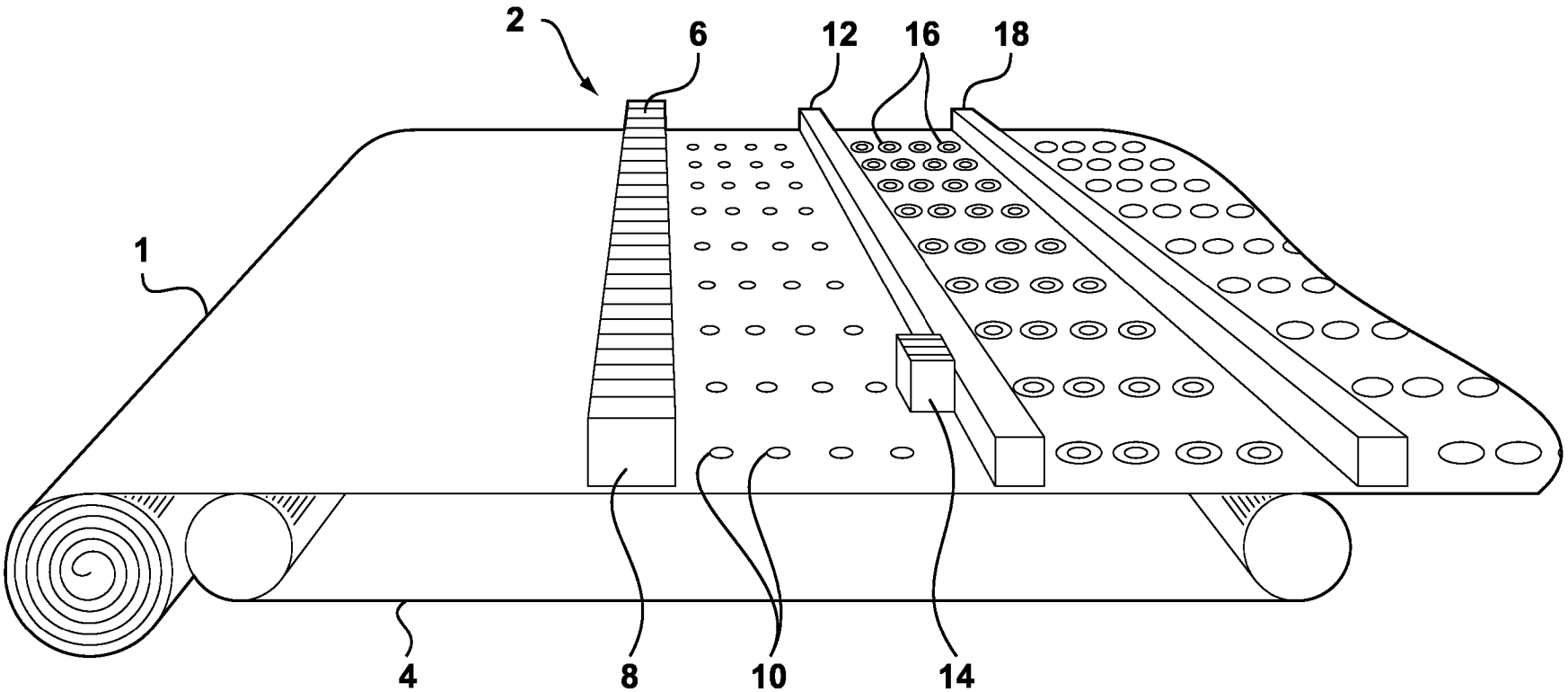
FIG. 1 shows an example of a digital encapsulation procedure according to the present invention.

The following is a description of certain embodiments of the invention, given by way of example only and with reference to the drawings. Referring to FIG. 1 shows schematically in perspective view a first example of a possible arrangement for depositing encapsulated functional droplets on a textile substrate. According to FIG. 1 there is shown a continuous roll of textile substrate 1 being fed to an upgrading device 2 according to the present invention. The textile substrate 1 is a standard cotton weave of a colour and weight suitable for the confection of men's shirts.

The substrate 1 is carried by conveyor 4 to a first beam 6 on which is arranged an array of 29 inkjet heads 8 of the continuous flow multilevel deflection type. Each inkjet head comprises a number (in this case 8) of individual nozzles (not shown).

The first beam 6 is supplied with a functional composition of an anti-microbial agent and deposits functional droplets 10 of the composition onto the textile substrate 1. In the present example, the functional droplets 10 are depicted in exaggerated scale to aid visualisation. In actuality it is understood that the functional droplets 10 would have a diameter of around 80 microns.

After the first beam 6 is located a second beam 12 also comprising an array of inkjet heads 14 of the continuous flow multilevel deflection type. The inkjet heads 14 are supplied with an encapsulation composition, which is deposited as a second series of encapsulation droplets 16 covering the functional droplets 10.

For transport past the first and second beams 6, 12, the substrate 1 is partially affixed to the conveyor 4 to prevent shifting of the textile and ensure exact alignment of the functional and encapsulation droplets. This may be achieved by e.g. conventional adhesive or vacuum techniques. By combining the depositing operations into a single finishing device, accuracy of placement of the droplets is ensured. At the end of the conveyor 4, the substrate 1 is released and passes a curing beam 18. The curing beam 18 comprises a conventional UV light source that causes hardening of the encapsulation droplet thus forming a protective layer over the functional droplet.

In order for such compositions to be deposited using present inkjet technology, the compositions may be formulated to meet the specifications as defined in Table I below.

General information on the properties specified:

Conductivity: this is required in CIJ techniques to allow charging of the droplets, so that they can then be deflected for printing, using an electric field. For all other inkjet techniques conductivity is undesirable as it encourages corrosion of metal components in contact with the ink.

Salt content: this is linked with the above comments on conductivity; some specific salts such as chlorides are particularly undesirable as they are more corrosive than other salts. The salts used in CIJ inks formulations should be selected to give the desired level of conductivity whilst minimising their corrosion promoting effects. Furthermore, in thermal inkjet formulations, multi-valent metal salts (such as Mg2+ and Ca2+) should be avoided as they promote kogation (crusting of the print head heater element) and will lead to premature failure of the print head.

properly and will leave air pockets, which will prevent reliable printing. If the surface tension of the fluid is too low, the meniscus will not form properly in the print head nozzle and in the case of DoD, fluid will spontaneously flow onto the print head faceplate (known as faceplate wetting) which will also prevent reliable jetting. In the case of CIJ, droplet break-up will be unreliable.

Particle size: inkjet nozzles are very small (typically of the order of 20-75 um) and so the maximum particle size of the fluid that can be printed is limited to prevent blocking of the print head nozzles. The maximum particle size allowable is substantially smaller than that of the nozzle as crowding effects can occur when a number of particles attempt to flow through the nozzle at the same time and cause a blockage by jamming against one another. For this reason, the maximum particle size allowable is also to some extent linked with the concentration of particles used.

pH: is typically used to control solubility (or dispersion stability) of active components of the fluid. The pH range that the print head can operate within is limited by corrosion of the materials that it is constructed from. For piezo DOD, ceramic print heads are available, which allow fluids across the full range of pH to be reliably jetted.

TABLE I

| | InkJet print head technologies Coating property requirements | | | | |
|---|---|---|---|---|---|
| | Drop on demand (DOD) | | | Continuous (CIJ) | |
| Property | Thermal (TIJ) | Piezo | Valvejet | Binary | Multi-deflection |
| Conductivity (uS/cm) | 0 | 0 | 0 | >500 +/− 20%*1 | >500 +/− 20%*1 |
| Salt content Chlorides (ppm) | <10 | <100 | <100 | <100 | <100 |
| Viscosity (cP)@ operating temp. | 1-4 +/− 0.25*2 | 2-15 +/− 0.25-0.5*2 | 2-20 | 1-2.5 +/− 0.25*2 | 2-4 +/− 0.5*2 |
| Surface tension(dynes/cm) | 30-50 | 25-45 | 25-50 | 20-50 | 20-50 |
| Particle size limit (um) | 0.5 | 1 | 5 | 0.5 | 2 |
| pH | 4-10 | 4-10*3 | 4-10 | 4-10 | 4-10 |
| % solids(residual) | <4 | <20*4 | <20 | <4 | <15 |
| Stable to shear rate of (s − 1) | $10^5$ | $10^5$ | $10^5$ | $10^6$ | $10^6$ |
| Dot diameter (um) | 20-250 | 20-250 | 100-5000 | 50-300 | 100-2000 |
| Droplet volume (pL) | 2-200 | 2-200 | 150-100,000 | 50-250 | 50-750 |
| Droplet velocity (m/s) | 15 | 5-10 | 10 | 20 | 20 |
| Firing frequency (kHz) | 30 | 30 | <2 | 64-1000 | |

*1tolerance during operation (recirculation of ink)

*2typical ink manufacturing batch to batch tolerance

*3unless using a ceramic print head, in which case pH 1-14 may be used

*4except in the case of UV curing ink which may be up to 100% solids

Viscosity: relative to most dispensing techniques, inkjet requires low viscosity fluids. Often the print head will be heated to reduce the viscosity of a fluid and allow it to be inkjet printed (this also reduces the effect of changes in ambient temperature on printing reliability). Newtonian fluids are preferred for inkjet deposition; however shear thinning fluids may be used with care. Shear thickening fluids should be avoided. Achieving the desired viscosity for a fluid does not guarantee inkjet printing success as other aspects of the fluid's flow properties are also important to the inkjet printing process, such as elasticity and can prevent reliable jetting of a fluid that appears to have the correct viscosity.

Surface tension: broadly speaking controls the wetting of the fluid inside the print head. If the surface tension is too high, the fluid will not wet the internals of the print head % solids: the solids content of the fluid is limited by viscosity (and elasticity) as well as particle size, as described previously. However, if the solids content of the fluid is too high then it can also over damp the pressure pulse used to eject (or break up) the inkjet drop and prevent reliable printing.

Stability to shear: inkjet printing is a high shear technique and so material that is not stable to high shear may decompose in the print head nozzle, blocking it (or the return gutter for a CIJ system) and also may cease to provide the desired application or end user properties on the substrate. For CIJ, the shear experienced is in the nozzle is greater than by the other inkjet techniques and also the fluid is re-circulated and so may pass through the nozzle many times, therefore shear stability is of increased importance for this technique.

To achieve these characteristics, preferably the finishing composition comprises the components as defined in Table II below.

TABLE II

| Finishing Composition Compositions defined by % By weight | Binary CIJ | Multi-deflection CIJ | Thermal InkJet (TIJ) | Piezo DOD |
|---|---|---|---|---|
| Solvent | 70-95 | 50-90 | 70-95 | 60-90 |
| Cosolvent | 0 | 0-20 | 0-3 | 0-5 |
| Humectant | 0-3 | 0-5 | 10-30 | 10-35 |
| Viscosity control agent | 0-2 | 0-25 | | 0-25 |
| Conductivity agent | 0-0.5 | 0-0.5 | | |
| Surfactant | 0-0.5 | 0-0.5 | | |
| Biocide | 0-0.5 | 0-0.5 | 0-0.5 | 0-0.5 |
| pH modifier | 0-1 | 0-1 | 0-1 | 0-1 |
| Corrosion inhibitor | 0-0.2 | 0-0.2 | 0-0.2 | 0-0.2 |
| Wetting Agent | 0 | | 0.01-0.3 | 0.01-0.3 |
| Active agent(s) | 5-20 | 5-30 | 1-5 | 5-30 |

For most cases, the solvent or vehicle is preferably de-ionized, de-mineralized water as this provides the best chemical basis for interaction of the active agent with the textile. Alternative finishing compositions using non-water based solvents such as ethanol or lactates may also be employed where the desired characteristics are appropriate or so require. This may be the case where a second layer is to be laid over a water based composition where compatibility with the underlying layer is undesirable, where fast drying is required or where the active agent react with water. In particular lactates are believed to be very good at penetrating cellulosic textiles.

Co-solvent may often be required to improve the solubility of the active component(s) and/or its compatibility with the conductivity agent (as incompatibility between these materials is a common formulation issue). Typically the co-solvents are low boiling point liquids that can evaporate from the surface of the substrate after acting as the carrier of the active component. It is preferable to use a co-solvent selected from the group consisting of ethanol, methanol and 2-propanol.

Humectant is usually a low volatility, high boiling point liquid that is used to prevent crusting of the nozzle when the jet(s) are not active. Preferably the humectants are selected from the group consisting of polyhydric alcohols, glycols, especially polyethylene glycol (PEG), glycerol, n-methyl pyrrolidone (NMP). Although with certain formulations it may appear that more than 5% humectant is being used, it is in fact the case that the same material may also be present as a viscosity modifier.

Viscosity control agent is the key ingredient for inkjet printing reliability and quality as it controls the droplet formation and break up process—often this material is also an 'active component' and provides some of the end user properties. Generally, high molecular weight polymers in solution should be avoided as their elasticity makes achieving jet break up difficult. Preferred viscosity control agents include polyvinylpyrrolidone (PVP), polyethylene oxide, polyethylene glycol (PEG), polypropylene glycol, acrylics, styrene acrylics, polyethyleneimine (PEI), polyacrylic acid (PAA). K-30 weight grade PVP has been found particularly useful due to its low bacterial sensitivity and its non-ionic nature.

Conductivity is required for CIJ to allow the droplets to be charged and therefore deflected and conductivity agents are used when insufficient conductivity is naturally present in the ink. Conductivity agents must be selected that are compatible with the other components of the formulation and do not promote corrosion. Known conductivity agents suitable in this regard include lithium nitrate, potassium thiocyanate, dimethylamine hydrochloride, thiophene-based materials, for example polythiophene or thiophene copolymers including 3,4-ethylenedioxythiophene (EDT) and polyethylenethiophenes. Potassium thiocyanate has been found particularly useful for jetting purposes as relatively little is required to achieve the desired conductivity. Conductivity salt is used when insufficient conductivity is naturally present in the ink. Conductivity is required to allow the droplets to be charged and therefore deflected. Selecting salts that are compatible with the other components of the formulation and do not promote corrosion is vital.

Surfactants are typically included either to reduce foaming of the formulation and release dissolved gases or to lower the surface tension of the droplet and thereby improve wetting. Preferable surfactants may include Surfynol DF75™, Surfynol 104E™ Dynol 604™ (all available from Air Products) and Zonyl FSA™ (available from Du Pont). BYK 022™ (available from BYK-Chemie) and Respumit S™ (available from Bayer) are both silicone based antifoam agents that have proved very effective for jetting purposes.

Wetting agents are utilized to improve the surface wetting of the fluid on the internal capillaries of the digital nozzle. Preferred wetting agents include acetylinic diols. Surfactants and co-solvents may also function as wetting agents.

Biocide is used to prevent bacteria growing in the ink—often this is not required if other components of the ink (such as IPA) are sufficiently concentrated to kill bacteria.

pH modifiers are used to maintain a pH at which the solids of the ink are soluble (or stably dispersed), typically this is pH>7, so most are alkaline. The pH modifier may also be used to affect the chemistry of the interaction between the composition/active agent and the textile itself. Ammonia, morpholine, diethanolamine, triethanolamine and acetic acid are suitable pH modifiers. Generally, it is desirable from an inkjet perspective to use relatively neutral solutions to reduce corrosion in the printheads.

Corrosion inhibitor is used to prevent unwanted ions present in the fluid (usually as impurities coming from the active components) from causing corrosion of the printer.

Under certain circumstances, UV cure resins may also be desirable, particularly where a highly durable finish is desired. Such resins may be appropriate for the encapsulation droplet.

While the above examples illustrate preferred embodiments of the present invention it is noted that various other arrangements may also be considered which fall within the spirit and scope of the present invention as defined by the appended claims.

What is claimed is:

1. A method of providing deposits of a functional composition on a textile substrate comprising:

providing a supply of the textile substrate;

providing a first digital nozzle;

supplying a functional composition to the first nozzle;

providing a second digital nozzle;

supplying an encapsulating composition to the second nozzle;

selectively depositing the functional composition from the first nozzle to form a series of functional droplets on the substrate; and selectively depositing the encapsulation composition from the second nozzle to form a series of encapsulation droplets to at least partially cover the functional droplets.

2. The method according to claim 1, wherein the textile substrate is supplied in a continuous manner.

3. The method according to claim 1, further comprising a transport surface for moving the textile substrate past the first and second nozzles, the substrate being retained by the transport surface for movement therewith.

4. The method according to claim 1, wherein the encapsulation droplets are larger than the functional droplets and each encapsulation droplet substantially covers a corresponding functional droplet.

5. The method according to claim 1, wherein a plurality of encapsulation droplets together cover a single functional droplet.

6. The method according to claim 1, further comprising:

providing a third digital nozzle;

supplying a foundation composition to the third nozzle;

selectively depositing the foundation composition from the third nozzle prior to depositing the functional composition, to form a series of foundation droplets on the substrate, the functional droplets being subsequently deposited on the foundation droplets.

7. The method according to claim 6, wherein the foundation droplets form a protective layer to prevent degradation of the functional droplets.

8. The method according to claim 6, wherein the foundation droplets form a rate-determining layer to control a rate of activity of the functional droplets.

9. The method according to claim 1, wherein the encapsulation droplets form a protective layer to prevent degradation of the functional droplets.

10. The method according to claim 1, wherein the encapsulation droplets form a rate-determining layer to control a rate of activity of the functional droplets.

11. The method according to claim 1, wherein the functional composition is temperature sensitive and the deposition of the functional droplets takes place at a temperature below 40° C.

12. The method according to claim 1, wherein the functional composition is sensitive to environmental conditions and the deposition of the functional droplets and the encapsulation droplets takes place in a controlled environment.

13. The method according to claim 1, wherein the nozzles comprise continuous flow inkjet nozzles and droplets are deposited by continuous flow jet deposition.

14. The method according to claim 13, wherein the nozzles comprise multi-level deflection type nozzles and droplets are deposited by applying a charge to the droplets and directing them onto the substrate using an electric field, either the charge or the field being varied.

15. The method according to claim 1, further comprising providing a static array of the first, second and/or third digital nozzles, aligned generally perpendicular to a direction of textile supply.

* * * * *